United States Patent [19]

Jenkins

[11] 4,164,931

[45] Aug. 21, 1979

[54] THERMAL DEFLECTOR

[76] Inventor: James H. Jenkins, 6010 N. 26th St., Arlington, Va. 22207

[21] Appl. No.: 733,872

[22] Filed: Oct. 19, 1976

[51] Int. Cl.[2] ..... F24B 9/04

[52] U.S. Cl. ..... 126/132; 126/141; D23/94

[58] Field of Search ..... 126/120, 132, 133, 141, 126/274, 130, 131; 237/8 R; D23/94

[56] References Cited

U.S. PATENT DOCUMENTS

| | | | |
|---|---|---|---|
| 306,178 | 10/1884 | Roberts | 126/131 |
| 313,998 | 3/1885 | Deardorff | 126/131 |
| 563,005 | 6/1896 | Backus | 126/132 |
| 677,542 | 7/1901 | Heitland | 126/132 |
| 1,152,912 | 9/1915 | Russell | 126/132 |
| 1,314,968 | 9/1919 | Maritzen | 126/131 |
| 2,825,326 | 3/1958 | Flynn, Jr. | 126/141 |

*Primary Examiner*—Ronald C. Capossela

[57] ABSTRACT

An apparatus to be installed in a fireplace to deflect and reflect heat from a fire in a fireplace.

1 Claim, 3 Drawing Figures

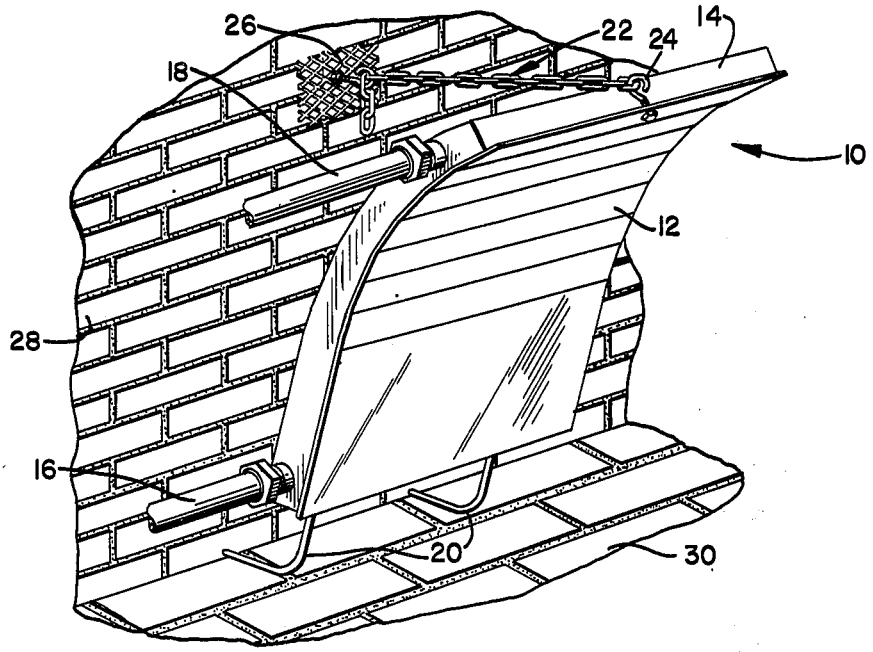
FIG. 1
FIG. 2
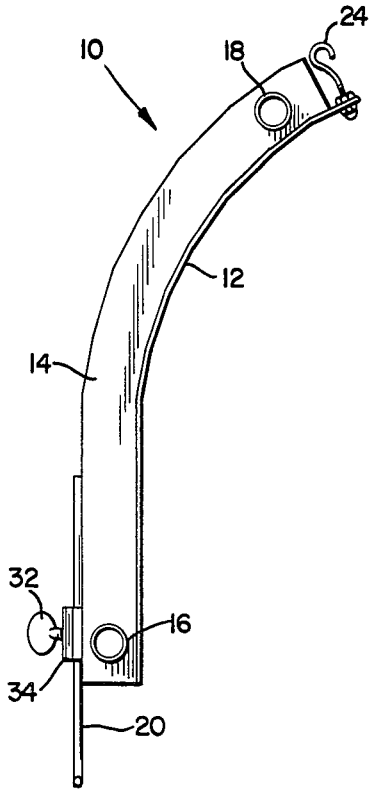
FIG. 3
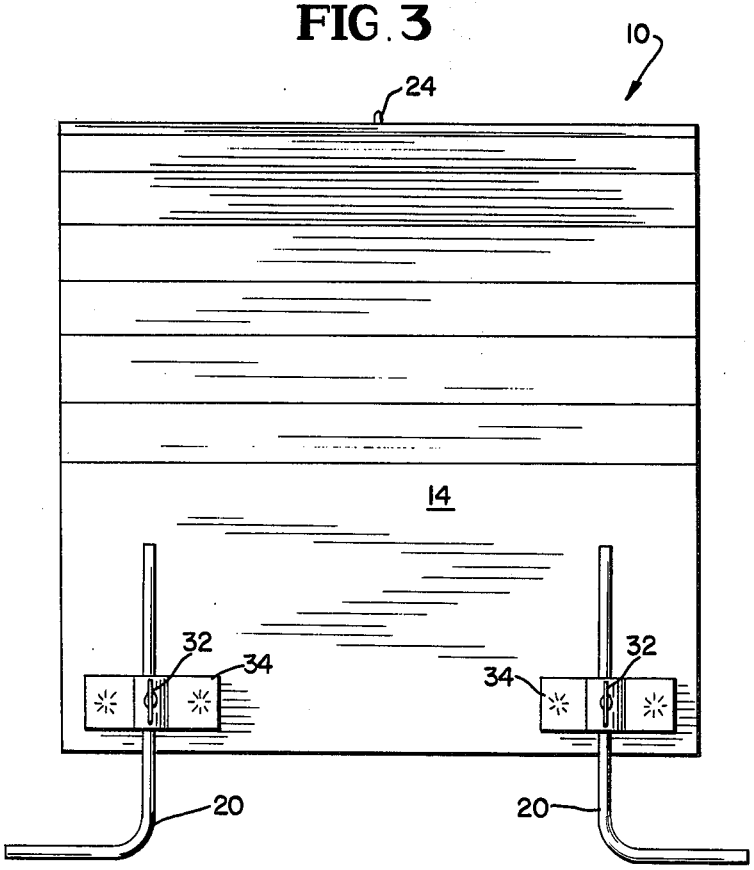

THERMAL DEFLECTOR

BACKGROUND OF THE INVENTION

Field of Invention

This invention relates to the use of a device to be placed in a fireplace to produce additional heat for the home. It particularly relates to removing heat from the fireplace by three methods—1. radiant, 2. circulation, 3. water.

REVIEW OF THE PRIOR ARTS

Because in the past, as in the present time, fireplaces are very rarely built to function as an efficient heating method, due to a number of reasons. 1. Very few mechanics have the knowledge, or the skills to build a good fireplace. 2. If the back of the fireplace is not constructed exactly right, the fireplace will give off very little heat. 3. If the firebox is too large, it will allow very little heat to escape into the room. 4. If the flue pipe is not the right size, the fireplace will smoke or give off very little heat, or both.

BRIEF DESCRIPTION OF THE DRAWING

FIG. 1—is a perspective view of the invention mounted inside a fireplace with the rotatable legs adjusted for maximum clearance from the fireplace back wall.

FIG. 2—is a side elevational view with the legs adjusted for maximum clearance from the wall.

FIG. 3—is a rear view of the invention showing the adjustment means for the legs, both height and distance from the back wall.

DESCRIPTION OF THE PREFERRED EMBODIMENT

THERMAL DEFLECTOR UNIT (10) Heat exchanger chamber (14) which is part of the Thermal Deflector unit (10) has an inlet (16) and an outlet (18) and a curved surface (12) Thermal Deflector unit (10) is set on two adjustable legs (20) which rest on floor of fireplace (30) mounted to the Thermal Deflector unit (10) by brackets (34) when adjusted to the desired height are then held in place by thumb screws (32) the Thermal Deflector unit (10) is made further adjustable by top angle adjustment means chain (22) which is attached to the Thermal Deflector unit (10) by means of hook (24) top angle adjustment (22) is also attached to back wall of fireplace (28) by means of a hook and wall attachment (26)

What is claimed:

1. A heat exchange and reflector device for use in a fireplace comprising: a heat exchange chamber having top, bottom, front, back and side panels, said chamber being forwardly curved such that the top panel is horizontally and vertically displaced from the bottom panel, at least one side panel having inlet conduit means and exit conduit means for heat exchange medium to be heated by the fire in the fireplace, a reflector surface attached to and conforming to the shape of the front panel of the heat exchange chamber, a pair of L-shaped legs adjustably connected to the back panel of the heat exchange chamber, hook means attached to the reflector surface and chain means communicating with said hook means for supporting the device in the fireplace.

* * * * *